US005718504A

United States Patent [19]

Huang

[11] Patent Number: 5,718,504

[45] Date of Patent: Feb. 17, 1998

[54] ANTI-LEAK AND ANTI-CONTACT CHRISTMAS LAMP

[76] Inventor: Shun-Feng Huang, No. 13, Lane 84, Nei Hu Road, Hsin-Chu City, Taiwan

[21] Appl. No.: 727,237

[22] Filed: Oct. 8, 1996

[51] Int. Cl.[6] ..... F21V 31/00

[52] U.S. Cl. ..... 362/267; 362/226; 362/396

[58] Field of Search ..... 362/226, 238, 362/249, 267, 396, 806

[56] References Cited

U.S. PATENT DOCUMENTS

| | | | |
|---|---|---|---|
| 4,667,276 | 5/1987 | Cheng | 362/249 |
| 5,139,343 | 8/1992 | Lin | 362/226 |
| 5,161,881 | 11/1992 | Myson | 362/249 |
| 5,667,296 | 9/1997 | Cheng et al. | 362/267 |

*Primary Examiner*—Stephen F. Husar

*Attorney, Agent, or Firm*—Morton J. Rosenberg; David I. Klein; Jun Y. Lee

[57] ABSTRACT

An anti-leak and anti-contact Christmas lamp includes a bottom cap, a tubular socket, a coil spring, an insulating disc and an anti-lead gasket. The bottom cap has curved recesses abutting each other on a projecting portion between two parallel walls and ridges between two abutting curved recesses for laying wires therein. The socket has a bottom annular wall with two opposite openings each having curved recesses to correspond with the curved recesses of the bottom cap so as to tightly pressing wires therein, the spring and the insulating disc are placed in the socket, with the disc pressed down by a lamp and with the spring compressed down to let the poles of the lamp contact with two conductors. The anti-leak gasket is fixed on and with an annular upper wall of the socket and tightly in contact with the glass of the lamp to prevent water from leaking into the socket and persons from extending hands into the socket.

2 Claims, 4 Drawing Sheets

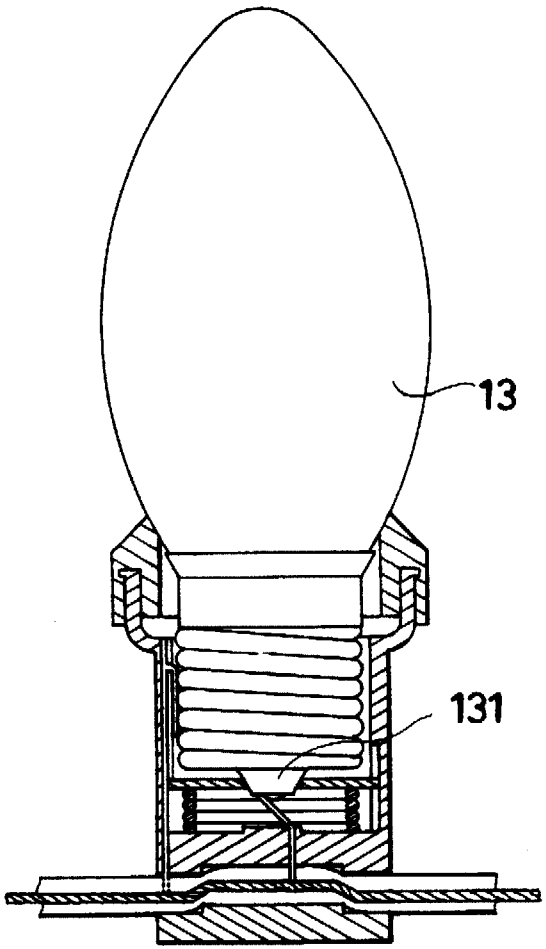
FIG. 5
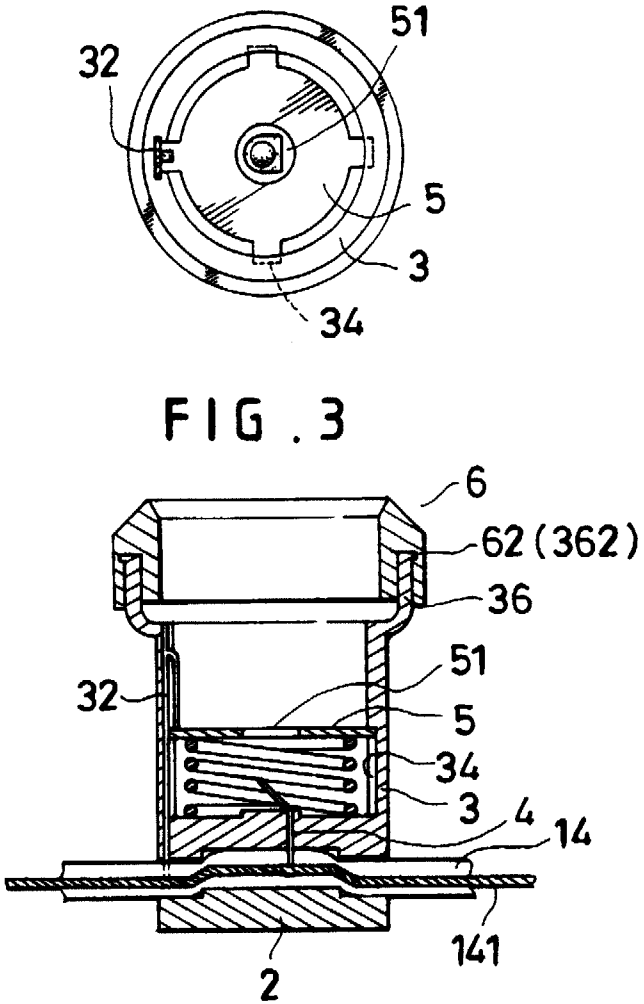
FIG. 4
FIG. 3

ANTI-LEAK AND ANTI-CONTACT CHRISTMAS LAMP

BACKGROUND OF THE INVENTION

This invention concerns a Christmas lamp, particularly able to prevent water from leaking into its socket and also prevent persons from extending hands into the socket to touch conductors to be electrified.

Christmas lamps are quite popular for celebrating Christmas either in West or in East nowadays, and indoor or outdoor Christmas lamps are widely used, and outdoor Christmas lamps are generally large and varied in colors.

One known outdoor Christmas lamps shown in FIGS. 7 and 8 includes a socket 11, a bottom cap 12 and a lamp 13 as main components combined together.

The socket 11 has female threads 111, a long conductor 112, and a short conductor in an inner vertical surface, a curved groove 114 formed in a bottom surface for electric wires to fit therein and compressed by the bottom cap at the same time. The long and the short conductor 112, 113 respectively have a pointed tip 115, 116 to pierce to contact with cores 141 of the electric wires 14.

The known conventional Christmas lamp has been in use for years because of simple structure, but found to have disadvantages as follows.

1. There is a large gap between the socket and the lamp after combined together, so often snow fallen down to stay on the Christmas lamps will melt to flow into the sockets through the gaps, causing electric short-circuit.

2. The socket has two U-shaped openings for electric wires to fit therein in the bottom wall, but the electric wires are generally round, so gaps exit between the openings and the wires to let water may flow through the gaps into the socket to cause electric short-circuit.

3. In case that there is one of sockets left without a lamp in many Christmas lamps connected in series and with power on, chances are that any playful child may extend a hand with curiosity to touch the conductors of the socket and be electrified.

SUMMARY OF THE INVENTION

This invention has been devised to offer an anti-leak and anti-contact Christmas lamp chiefly used outdoors.

One feature of the invention is a socket and a bottom cap both having curved grooves and projecting ridges between two abutting curved grooves for tightly contacting with outer skins of electric wires fitted between them so as to leave no gaps, preventing water from flowing through into the socket.

Another feature of the invention is an annular anti-leak gasket fixed on and with an annular upper wall of the socket, sealing the gap between the lamp and the socket, preventing water from flowing into the socket along the glass of the lamp.

One more feature of the invention is a coil spring and an insulating disc both deposited in the socket. When the lamp is not yet screwed in the socket, the insulating disc is lifted up by the coil spring to a proper height, hiding the long and the short conductor and keeping them from reached by hands or other conductive pieces.

BRIEF DESCRIPTION OF DRAWINGS

This invention will be better understood by referring to the accompanying drawings, wherein:

FIG. 3 is an upper view of the first preferred embodiment of an anti-leak and anti-contact Christmas lamp in the present invention;

FIG. 4 is a cross-sectional view of the first preferred embodiment of an anti-leak and anti-contact Christmas lamp in the present invention;

FIG. 5 is a cross-sectional view of the first preferred embodiment of an anti-leak and anti-contact Christmas lamp in the present invention;

DESCRIPTION OF THE PREFERRED EMBODIMENTS

Figure 1:
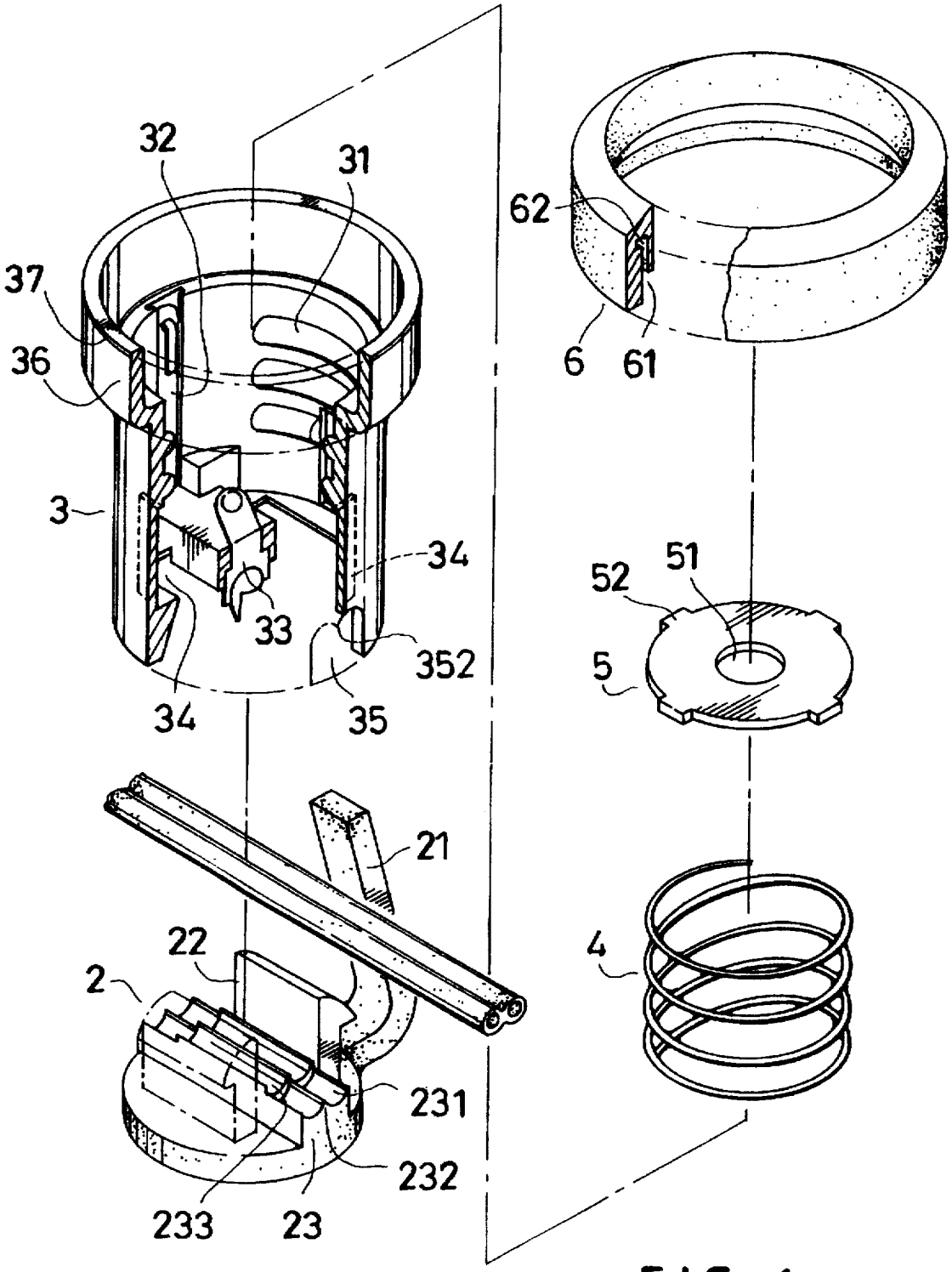
FIG. 1 is an exploded perspective view of a first preferred embodiment of an anti-leak and anti-contact Christmas lamp in the present invention.
Figure 2:
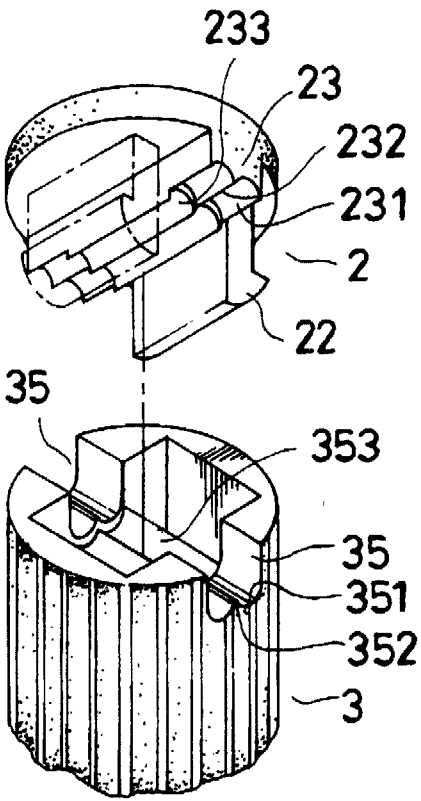
FIG. 2 is a partial exploded perspective view of the first preferred embodiment of an anti-leak and anti-contact Christmas lamp in the present invention.
Figure 8:
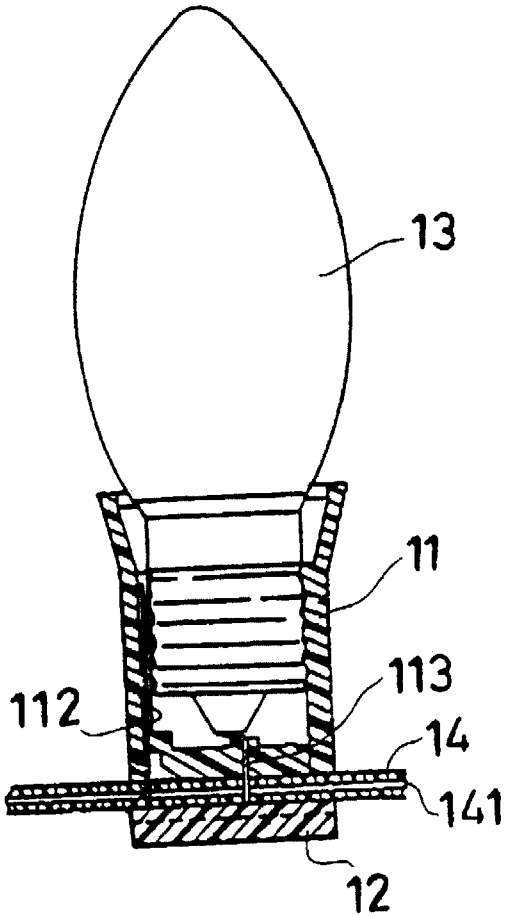
FIG. 8 (PRIOR ART)
FIG. 8 is a cross-sectional view of the known conventional Christmas lamp.
Figure 7:
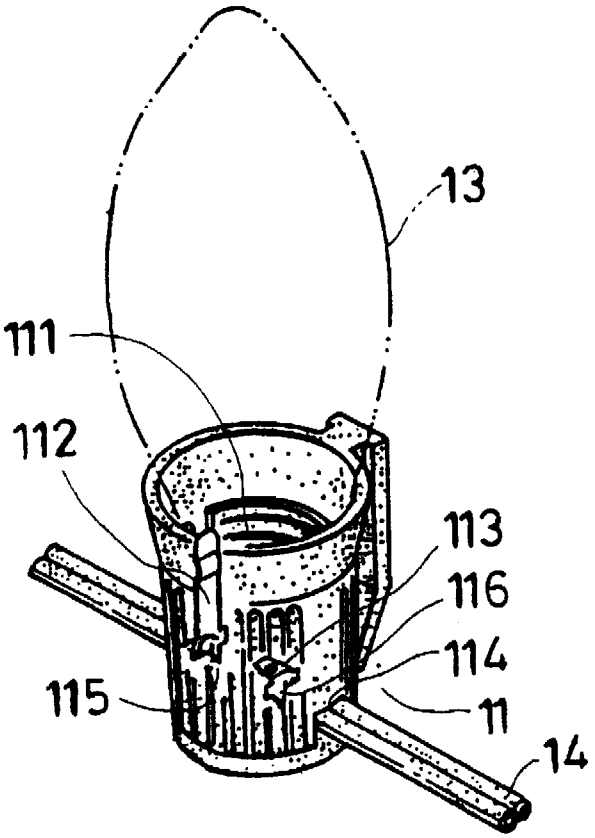
FIG. 7 (PRIOR ART)
FIG. 7 is a perspective view of a known conventional Christmas lamp.

A first preferred embodiments of an anti-leak and anti-contact Christmas lamp in the present invention, as shown in FIGS. 1 and 2, includes a bottom cap 2, a socket 3, a spring 4, an insulating disc 5 and an annular anti-leak gasket 6 as main components combined together.

The bottom cap 2 is shaped round, having an tightening bar 21 at one side, two opposite vertical fitting walls 22, 22 standing in parallel on an upper surface, a projecting-up portion 23 between the two fitting walls 22, 22. The projecting-up portion 23 has some straight curved recesses 231 abutting each other for depositing electric wires, projecting ridges 232 between each two abutting recesses 231, and an intermediate curved recess section 232 projecting up from the projecting-up portion 23.

The socket 3 has the same female threads 31, the same long conductor 32, and the short conductor 33 as those in the known conventional socket, in addition to a plurality of vertical long grooves 34 equidistantly spaced apart in an inner vertical surface, two opposite openings 35, 35 in a bottom annular wall, some curved recesses 351 abutting each other on a bottom of each opposite opening 35 for electric wires to lie thereon, a projecting ridges 352 between each two abutting recesses 351, 351 and some straight curved recesses 353 in line to the curved recesses 351 on a bottom surface surrounded by the bottom annular wall for electric wires to lie thereon. The socket 3 further has an annular upper wall 36 and a flange 37 at top of the wall 36.

The coil spring 4 is fitted under the insulating disc 5 in the socket 3, having a proper elasticity to urge the insulating disc 5.

The insulating disc 5 is located on the coil spring 4 in the socket 3 for receiving the bottom of a lamp 13, having a center hole 51 for a projecting bottom point 131 of the lamp 13 to fit through, and four projections 52 spaced equidistantly on a periperal edge.

The annular anti-leak gasket 6 has a proper flexibility, an annular groove 61 opening downward in the peripheral wall, and an annular recess 62 formed in the bottom of the annular groove 61.

In assembling, referring to FIGS. 3, 4 and 5, firstly, the coil spring 4 is deposited in the socket 3, then the insulating disc 5 is placed on and elastically urged by the coil spring 4 in the socket 3, with the projections 52 made to fit with force in the long grooves 34 making use of the material flexibility of the plastic socket 3 and the insulating disc 5. However, the coil spring 4 never pushes up the insulating disc 5 to separate from the long grooves 34 owing to the limited elasticity of the spring 4. Next, the anti-leak gasket 6 is engaged on and with the annular upper wall 36 of the socket 3, with the flange 37 fitting in the annular recess 62 so as to prevent the anti-lead gasket 6 from loosening off the socket 3. Electric wires 14 are laid across the two openings 35, 35 and compressed hard by the projecting ridges 232 of the bottom cap 2, letting cores 141, 141 of the wires 14 respectively contact with the long conductor 32 and the short conductor 33 so as to form a circuit. Lastly, the lamp 13 is screwed in the socket 3, with the projecting bottom point 131 protruding through the center hole 51 of the insulating disc 5, and with the insulating disc 5 gradually pushed down by the lamp 13 until the projecting bottom point 141 comes in contact with the short conductor 33 and a threaded section 132 of the lamp in contact with the long conductor 32. Then the lamp 13 is in tight contact with and protected by the anti-leak gasket 6.

Figure 6:
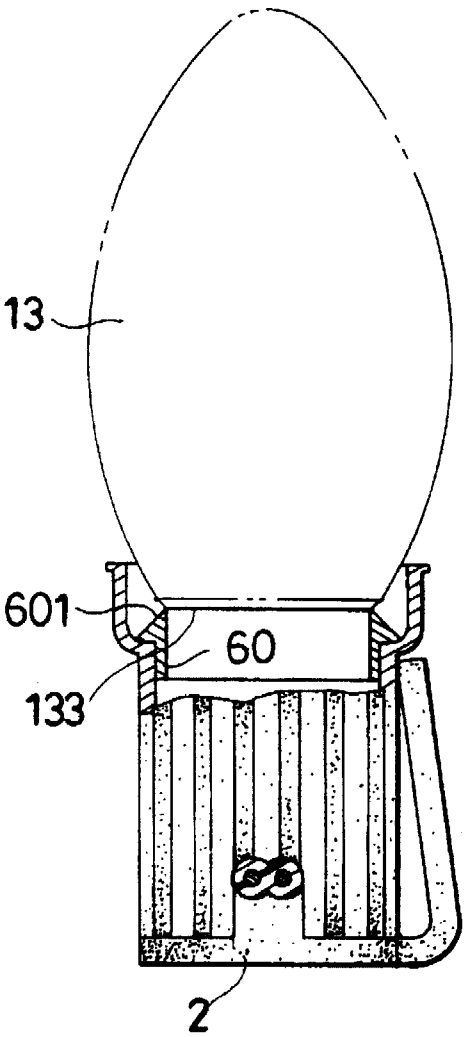
FIG. 6 is a cross-sectional view of a second preferred embodiment of an anti-leak and anti-contact Christmas lamp in the present invention.

A second preferred embodiment of an anti-leak and anti-contact Christmas lamp is shown in FIG. 6, having the same structure as the first preferred embodiment, except an annular anti-leak gasket 60 used instead of the annular anti-leak gasket 6 of the first preferred embodiment. The annular anti-leak gasket 60 has an annular upper sloped edge 601 fitting around the annular upper wall of the socket 3, and after the threaded section 132 of the lamp 13 passed through, with an upper end of the annular sloped edge 601 contacting with a copper socket edge 133 of the lamp 13. Then tightening the lamp 13 pay obtain proper tightness and water-preventing effect with the anti-leak gasket 60 pressed by the copper socket edge 133 and the annular upper wall 36.

As can be understood from the above description, this invention has advantages over the known conventional Christmas lamp, as listed below.

1. Provision of the curved recesses and the projecting ridges of the bottom cap and the curved recesses and projecting ridges of the socket obtains water leak preventing effect for the upper and the lower portion of the socket, with rain hampered from infiltrating into the socket to cause short-circuit.

2. As electric wires are tightly compressed by the projecting ridges of the bottom cap and the curved recesses of the socket fitting tensely around the outer skins of the electric wires so that water may be sufficiently prevented from leaking in the socket.

3. The insulating disc is automatically lifted up by the coil spring in case of the lamp taken off the socket, hiding the long and the short conductor, and thus preventing persons to extend hands to be electrified by contacting the conductors.

While the preferred embodiments of the invention have been described above, it will be recognized and understood that various modifications may be made therein and the appended claims are intended to cover all such modifications which may fall within the spirit and scope of the invention.

What is claimed is:

1. An anti-leak and anti-contact Christmas lamp comprising:

(a) a bottom cap member having a pair of opposingly located and vertically directed cap member lug members extending from an upper surface of said bottom cap member, said bottom cap member having a vertically projecting section located between said cap member lug members, said projecting section forming at least a pair of arcuately formed and adjacently located arcuately contoured recess portions extending in a longitudinal direction, each of said arcuately contoured recess portions having an intermediate recess section mounted in a respective recess portion for contiguous interface with a respective electrical wire;

(b) a socket member having a tubular contour, said socket member having a lower section and an upper section, said lower section having a ledge formed on an inner surface of a wall of said socket member for engaging said cap member lug members, and a through opening for passage therethrough of said electrical wire, said socket having female threads formed within said inner surface of said socket wall and a pair of conductors mounted thereto, said inner surface of said wall of said socket member having a plurality of arcuately displaced and vertically extending socket grooves formed therein, said upper section of said socket member forming a socket flange;

(c) a helical spring inserted within said socket member and mounted on said bottom cap member;

(d) an insulating disc mounted on top of said helical spring having a disc center opening and a plurality of spaced apart disc projections corresponding to said plurality of vertically extending socket grooves for guided vertical displacement of said insulating disc within said socket grooves; and, (e) an anti-leak gasket member having an annular contour and an annular groove formed therein for insert on said socket flange, said lamp having a glass upper section and a lower section passing through said disc center opening and having a lamp bottom end for contacting one of said conductors which is forced into contact with a core of said electrical wire, said lamp glass upper section being mounted in contiguous contact with a periphery of said gasket member.

2. The anti-leak and anti-contact Christmas lamp as recited in claim 1 where said anti-leak gasket member includes an inclined annular top surface for contiguous mating to an inclined outer surface of said lamp.

* * * * *